US007765718B2

(12) United States Patent
Wilkenfeld

(10) Patent No.: US 7,765,718 B2
(45) Date of Patent: Aug. 3, 2010

(54) DANCE SHOE WITH MOLDABLE FOOT COMPARTMENT

(75) Inventor: David Wilkenfeld, Sydney, NSW (AU)

(73) Assignee: Pointe Noir Pty Ltd. (AU)

( * ) Notice: Subject to any disclaimer, the term of this patent is extended or adjusted under 35 U.S.C. 154(b) by 841 days.

(21) Appl. No.: 11/674,967

(22) Filed: Feb. 14, 2007

(65) Prior Publication Data

US 2007/0199208 A1 Aug. 30, 2007

Related U.S. Application Data

(60) Provisional application No. 60/778,085, filed on Feb. 28, 2006.

(51) Int. Cl.
*A43B 5/12* (2006.01)

(52) U.S. Cl. ..... 36/8.3; 36/88; 36/93

(58) Field of Classification Search ..... 36/8.3, 36/88, 93, 154
See application file for complete search history.

(56) References Cited

U.S. PATENT DOCUMENTS

| | | | | |
|---|---|---|---|---|
| 1,754,054 | A | 4/1930 | Selva | |
| 1,872,641 | A | 8/1932 | Capezio | |
| 1,953,659 | A | 4/1934 | Savino | |
| 2,683,316 | A | 7/1954 | Reker et al. | |
| 3,895,405 | A * | 7/1975 | Edwards | 12/146 M |
| 4,026,046 | A * | 5/1977 | Clark et al. | 36/113 |
| 4,439,934 | A * | 4/1984 | Brown | 36/44 |
| 4,583,304 | A | 4/1986 | Spalding | |
| 4,901,453 | A | 2/1990 | Gaynor | |
| 5,035,069 | A | 7/1991 | Minden | |
| 5,129,165 | A | 7/1992 | Woodle | |
| 5,191,726 | A | 3/1993 | Vallee | |
| 5,220,735 | A | 6/1993 | Raoul-Duval | |
| 5,312,669 | A * | 5/1994 | Bedard | 428/105 |
| 5,740,618 | A | 4/1998 | Minden | |
| 6,895,693 | B2 | 5/2005 | Baruck | |
| 6,895,694 | B2 | 5/2005 | Nye | |
| 7,475,500 | B2 * | 1/2009 | Covatch | 36/100 |
| 2003/0029055 | A1 | 2/2003 | Morrone | |
| 2003/0033729 | A1 | 2/2003 | Farrior | |
| 2003/0070319 | A1 | 4/2003 | Minden | |
| 2003/0121176 | A1 | 7/2003 | Baruck | |
| 2004/0093761 | A1 | 5/2004 | Nye | |
| 2004/0194348 | A1 * | 10/2004 | Campbell et al. | 36/93 |
| 2004/0194352 | A1 * | 10/2004 | Campbell et al. | 36/174 |

OTHER PUBLICATIONS

Australia Examiner's report dated Nov. 20, 2008 for corresponding Australian patent application No. 2007200801, filed Feb. 22, 2007; 2 pages.

* cited by examiner

*Primary Examiner*—Marie Patterson
(74) *Attorney, Agent, or Firm*—Ganz Law, P.C.

(57) ABSTRACT

A dance shoe comprising a foot compartment or portion thereof that is malleable at a temperature above a temperature of intended use, and when malleable, the shoe is hand moldable to a conformation desired by a user. The invention particularly relates to en pointe shoes for ballet and other forms of dance.

15 Claims, 9 Drawing Sheets

DANCE SHOE WITH MOLDABLE FOOT COMPARTMENT

CROSS REFERENCE TO RELATED APPLICATIONS

This application claims priority to U.S. Provisional Application No. 60/778,085, filed Feb. 28, 2006, by David Wilkenfeld and Felicia Leoncelli entitled MOLDABLE, SUPPORTED DANCE SHOE, the contents of which are hereby incorporated by reference as if listed herein in their entirety for all purposes.

BACKGROUND

The present invention relates to shoes used in dance, particularly ballet. More particularly the present invention relates to a pointe shoe for ballet.

A pointe shoe is a ballet shoe that has a rigid toe box that helps support a dancer's foot and ankle during en pointe dancing and movements. Mastering the art of pointe work requires experience, strength and an awareness of one's body and its capabilities. Pointe shoes are aimed at these various stages of a dancer's strengths and abilities. For example, for a shoe for beginners/students this means the shoe has been developed for strengthening and support. Further a dancer's foot dynamically changes shape as it moves from flat to pointe and demi-pointe, and each part of the pointe shoe must accommodate specific demands and provide comfort and support. Accordingly, pointe shoes need to be properly fitted to a dancer's specific anatomy.

Pointe shoe's today have evolved very little from pointe shoes constructed centuries ago. The basic construction involves forming a toe box from layers of fabric, burlap, hessian cardboard, paper, plastic, leather, or any combination of the foregoing. The layers are typically saturated with glue to form a rigid toe box. The toe box is connected to a shank that is rigid and supports the underfoot. The shank may come in various lengths such as full, ¾, and ½ depending on the strength and experience of the dancer and the kind of dance for which the shoe is intended. The shank may be formed integral with the toe box or attached via adhesives, stitching, nailing, or any combinations of the foregoing. An upper 17 for surrounding the foot is connected to the shank and toe box using any of the same fastening techniques. The shoe also includes a strap system attached to the upper for securing and supporting the shoe onto the foot and ankle.

Conventional pointe shoes must be broken-in by a dancer to help provide a customized fit that facilitates comfort and support. The break-in procedure can be laborious and slow. Doing "barre" exercises is one way dancers break-in their pointe shoes. However, dancers cannot stand at the barre with a new pair of pointe shoes and expect to do a tendu, so the shoe needs to be prepared for barre by gently softening the shank and box by hand. The dancer concentrates on the demi-pointe area of the shank being careful not to crush the box. Then the dancer works up to the heel gently massaging the shank until it is at a point where tendu and releve to demi-pointe is comfortable. Softening the box is not always necessary and is left up to the individual. If softening is necessary then the dancer concentrates on gently softening the sides of the box. Many dancers stand on the top of the box in order to soften and widen it. However, standing on the box or squashing the box can permanently damage the shoe. If the dancer stands on the toe box, the dancer must concentrate the pressure on either side of the box center. This is important because the top center of the box is usually weakest point and prone to the most damage if stood on. Once the shoes are ready for barre, 1 to 2 hours of barre will be needed to shape them to a dancer's foot.

At this point the shoes will be evenly softened with no weak points resulting from an incorrect breaking technique.

Another approach for breaking-in pointe shoes applies to certain shoes that are made from a paste that is designed to soften when moisture is applied. The technique follows the technique above to prepare the shoe for barre. Then after 1 to 2 hours of barre the shoe should become moist and shape itself to the dancer's foot. Once the shoe dries it will have set in the shape of the dancer's foot. At this point, Shellac may be applied to the inside of the block and shank. Not only will this harden the shoe in its current shape, but it will also stop any more moisture entering the shoe. This results in a strong shoe, molded in the shape of the individual dancer's foot on the inside, while leaving a quiet exterior. However, shoes molded by this method are permanently set and cannot be adjusted, as a dancer may subsequently desire.

The traditional break-in techniques are also harsh on a shoe and can shorten the performance lifespan of the shoe.

It should be apparent from the foregoing that breaking-in a pointe shoe can be a laborious and time consuming task. Accordingly, there is a need for improved ballet shoes that honor traditional forms of construction, but which are more readily and easily broken-in by a dancer. There is also a need for shoes that can be readjusted to provide better fit or position. There is also a need for shoes that can be broken in easily without substantial loss of performance life span.

SUMMARY

The inventive subject matter disclosed herein addresses the foregoing needs by providing a compartment for a shoe, or portion thereof, such as a toe box and/or shank region that is relatively easily molded by a dancer for a custom fit. It is also re-moldable for adjustments and fine tuning. In certain embodiments, the present invention provides a toe box for a pointe or other dance shoe that is constructed from layers of toe box material that are treated with a thermoset adhesive such as water-based polyurethane. The toe box may be heated by the dancer using, for example, a standard blow dryer or other heat source to make the toe box malleable. While in the heated malleable condition, the dancer shapes the toe box into a desired configuration, and then allows the toe box to set into the configuration by cooling. The shoe may be placed in a reduced temperature environment, such as refrigerator to facilitate cooling and setting.

A moldable toe box may be integrated with an insole that also serves as a shank. In certain embodiments, the insole may be formed of a strong and durable plastic and optionally is adapted for selective flexing. For example, to provide selective flexibility, the insole may include flexural lines, varying thickness, multi-density construction, and/or laminated materials. In some embodiments, the plastic insole may be made of a thermoset plastic and is moldable by a user's application of heat. In other embodiments, the plastic insole is assembled to other layers of material and the shank region is moldable by a user's application of heat. In other embodiments, the shank is formed from traditional materials. In other embodiments, it is formed of traditional materials and treated with a thermoset adhesive so that it is moldable by a user's application of heat. These and other embodiments are described in more detail in the following detailed descriptions and the figures.

The foregoing is not intended to be an exhaustive list of embodiments and features of the present inventive concept. Persons skilled in the art are capable of appreciating other embodiments and features from the following detailed description in conjunction with the drawings.

DETAILED DESCRIPTION

Figure 1:
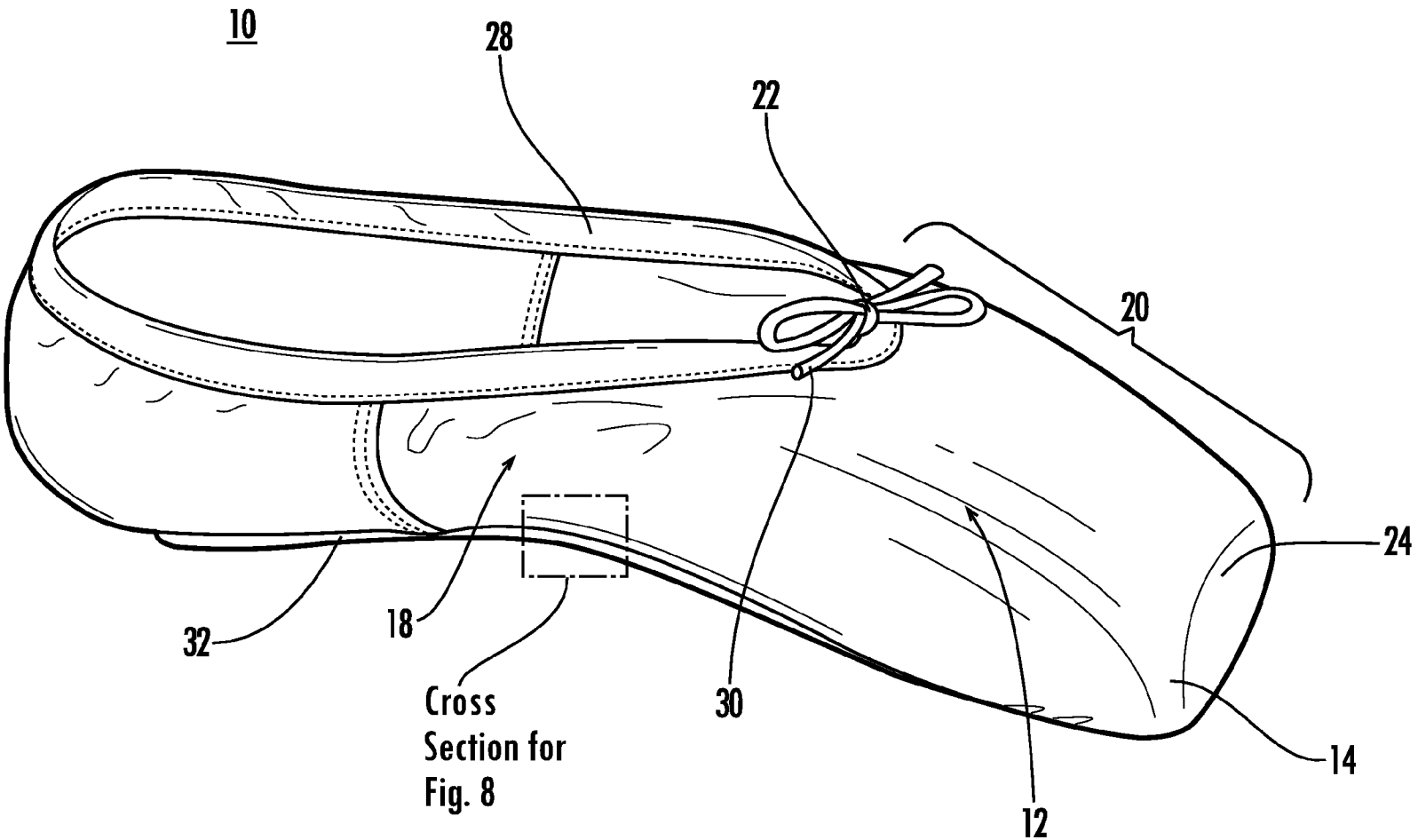
FIG. 1 shows a side perspective view of a dance shoe according to the inventive subject matter.
Figure 2:
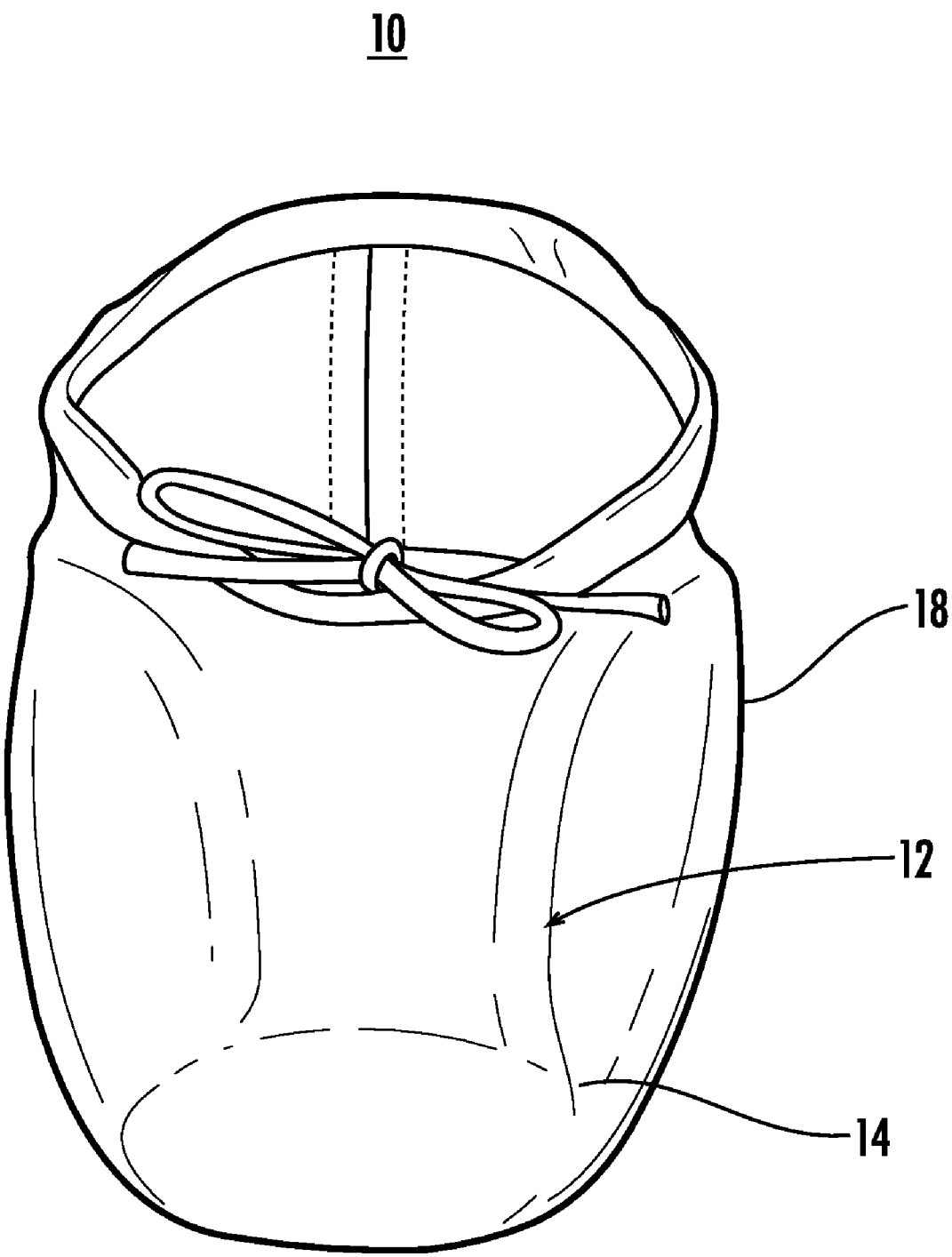
FIG. 2 shows a front perspective view of the shoe of FIG. 1.
Figure 3:
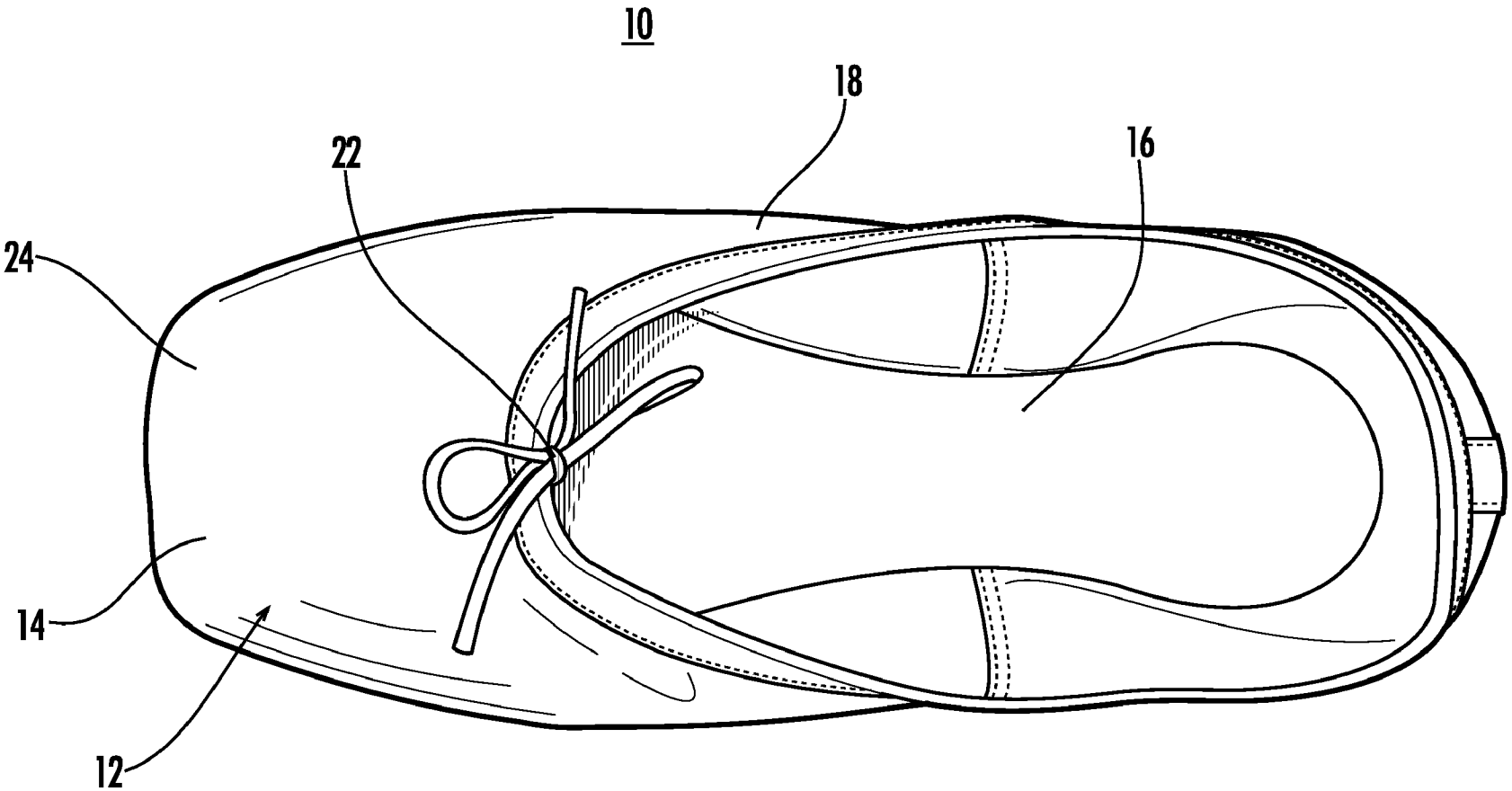
FIG. 3 shows a top view of the shoe of FIG. 1.
Figure 4:
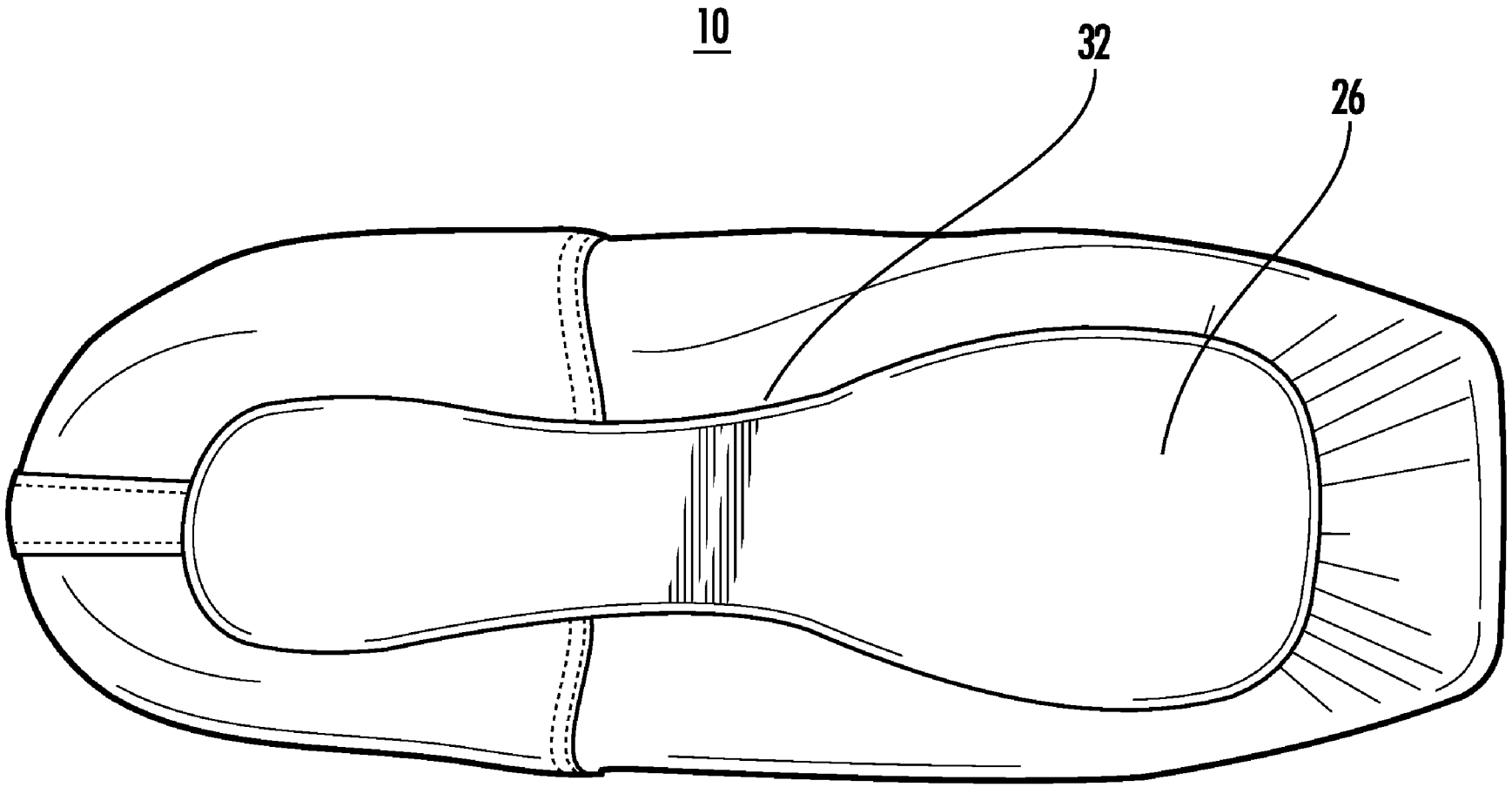
FIG. 4 shows a bottom view of the shoe of FIG. 1.
Figure 5:
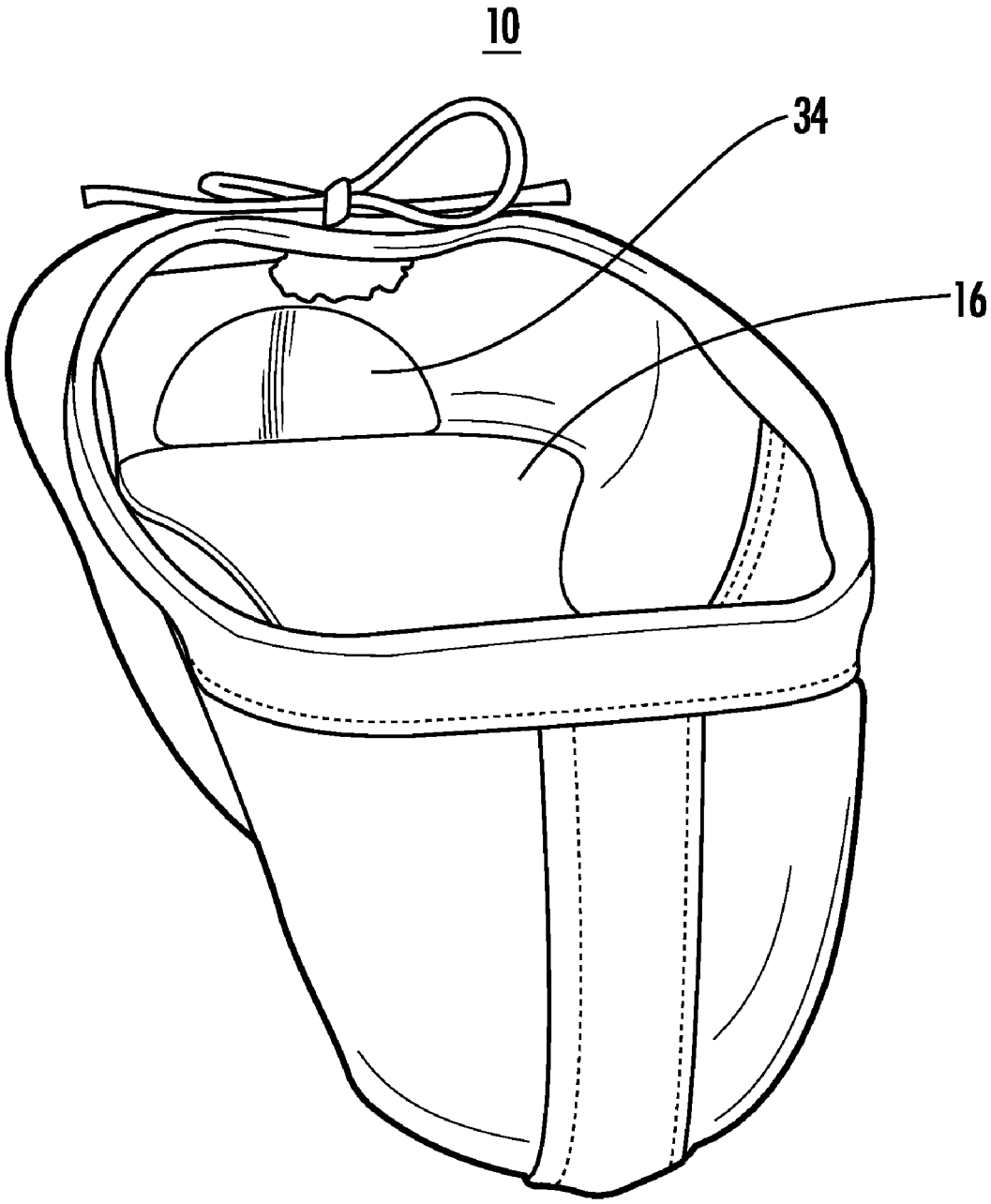
FIG. 5 shows a rear perspective view of the shoe of FIG. 1.
Figure 6:
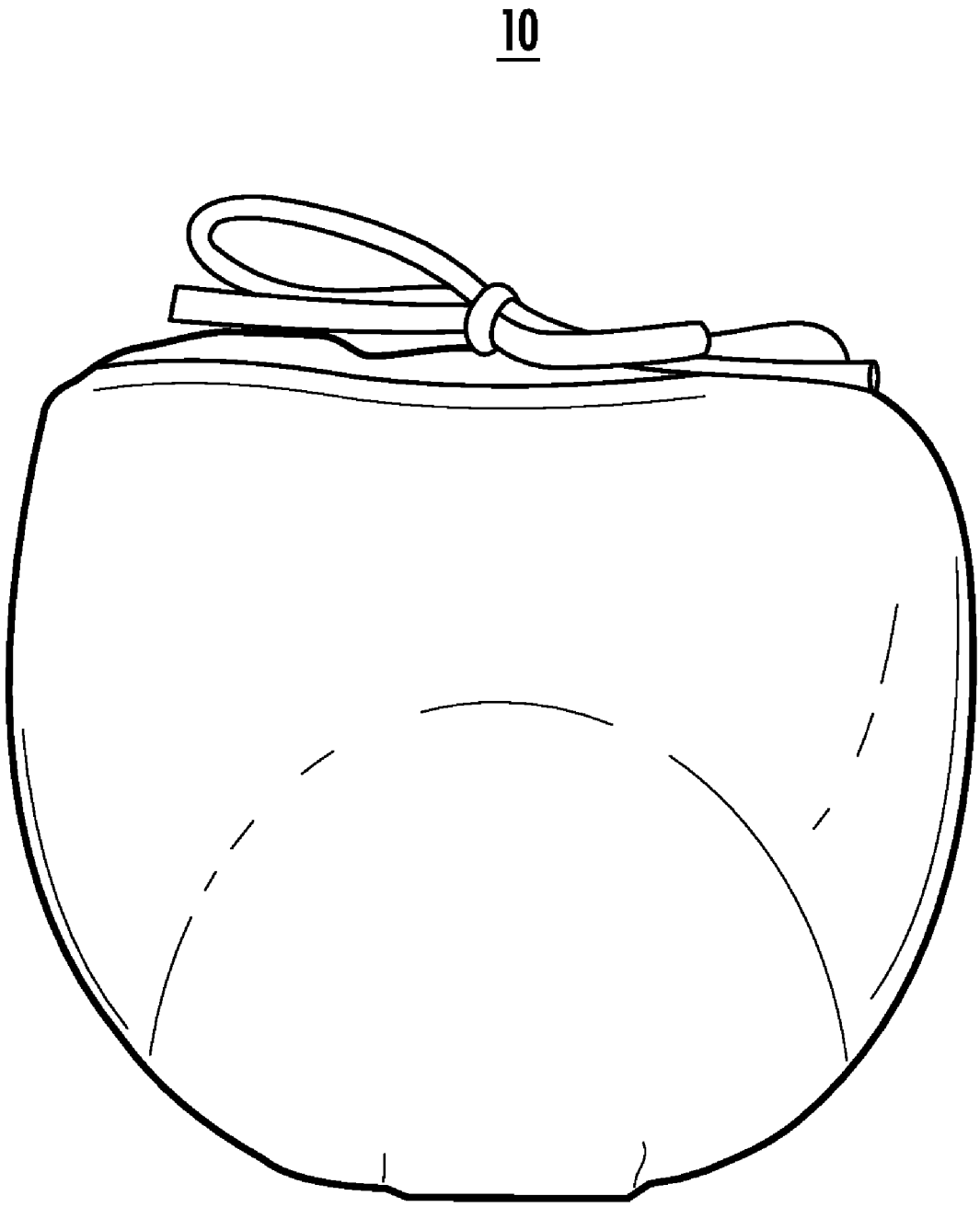
FIG. 6 shows a front view of the shoe of FIG. 1.
Figure 7:
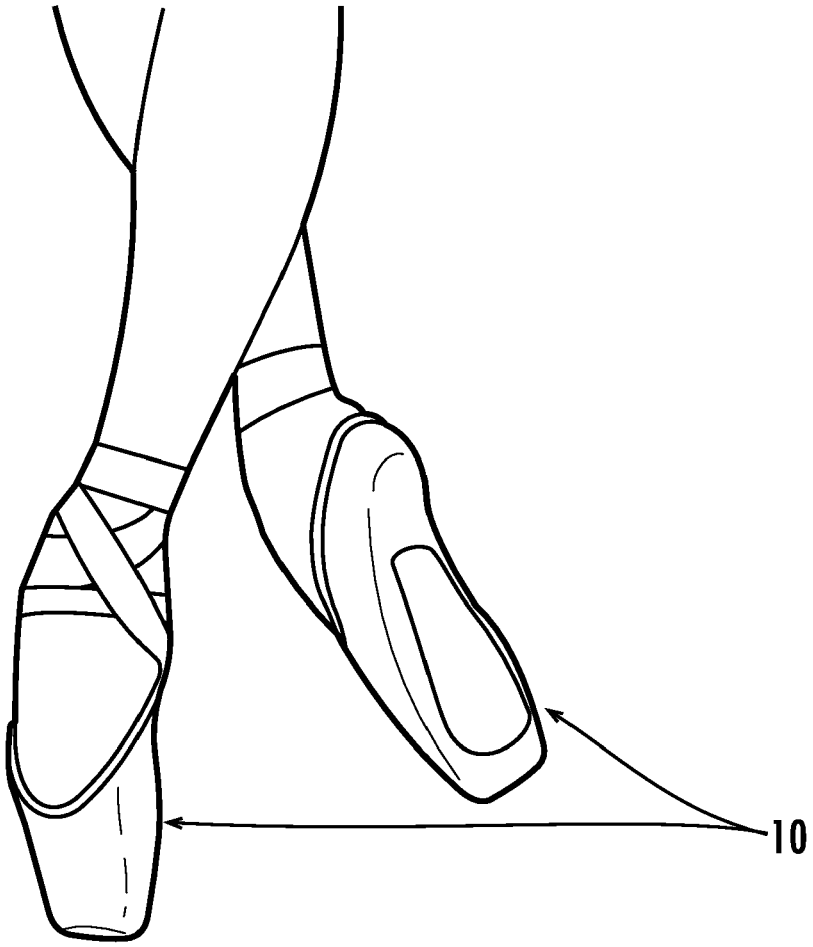
FIG. 7 shows the legs of a dancer wearing pointe shoes and standing en pointe.

Representative embodiments of the present inventive concept are shown in FIGS. 1-8 wherein similar features share common reference numerals.

The inventive subject matter may be used in any kind of shoe to provide a moldable compartment for fitting or aligning a foot in a desired manner. As used herein, a compartment means that portion of a shoe that surrounds at least the three sides of a foot along some of all the length of the foot. The portion may be any section along the length and/or width of the shoe, including plane sections, such as the underfoot arch area.

Generally, the compartment, or portion, thereof will have a desired rigidity during temperature range of intended use. Above the range the compartment will become malleable and therefore moldable by a user to a desired conformation. Once the heated compartment cools to within or below the temperature range of intended use, the compartment once again has a more rigid form. For ease of use, the inventive subject matter contemplates the compartment for use in an en pointe shoe will remain substantially rigid to support a dancer in typically en pointe movements at temperatures below about 35-38 degrees C., the approximate temperature range for a shod foot from resting to exertion. Above this temperature, the shoe may be designed to become malleable. In certain embodiments, the shoe is designed with thermosettable resin that becomes malleable above about 60 degrees C. Conveniently, this temperature for malleability may be achieved using a typical blow dryer for hair, outputting, for example, 1200-2000 watts at a high setting.

The inventive subject matter disclosed herein may be applied to traditional methods and materials for forming a toe box or other portion of the compartment of a shoe. These methods and materials are well-known in the art and do not need extra elaboration here. As one example, construction of pointe shoes is detailed in U.S. Pat. No. 6,895,694, to Nye, entitled TOE SHOE, which is hereby incorporated by reference as if set forth in its entirety.

FIGS. 1 to 8 illustrate a typical pointe shoe 10. The shoe includes a rigid toe box 12 that covers the toes and supports a dancer en pointe. The inside of the toe box may be lined with smooth or cushioning material for comfort. Side wings may extend rearwardly from the toe box along the side of a dancer's foot to provide lateral support. They may be an extension of the toe box. The toe box is configured using a last that creates a specific initial configuration for the toe box. Usually, the toe box for an individual shoe is configured so that it may be used on either the left or right foot. The toe box includes a platform 14, which is the squared front section of the toe box that contacts the ground when a dancer is standing en pointe.

Figure 8:
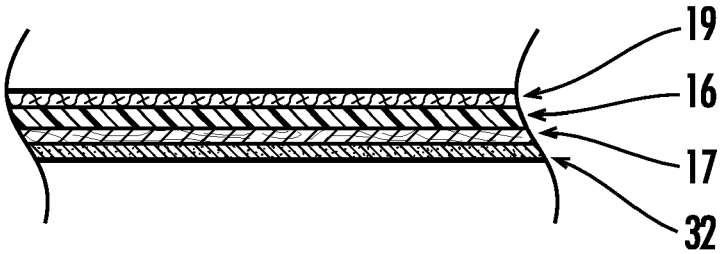
FIG. 8 shows an enlargement of the encircled shank section 8-8 of FIG. 1, and is an example of a possible cross-section of a midfoot portion of a shoe according to the inventive subject matter.

An underfoot support element, such as a shank or insole 16, is coupled to the toe box and extends rearwardly toward the heel. It supports the foot at least through the arch and structural ties into toe box to facilitate the shoe's support of the foot and ankles. The support element may be in any configuration the serves the aforementioned functions. It may be directly or indirectly connected to the toe box, including being formed as unitary extension of the toe box. It may be based from one or more of boards, such as, cardboard redboard, fiberboard, Texon board, leathers, plastics, woods, metals, and other materials that may be assembled or formed into a rigid structure. The shank may be selectively flexible. FIG. 8 shows an example construction of a midfoot region with a substantially rigid insole 16. The insole would typically correspond to the width of a foot. In this example, it is disposed above a layer of canvas (not shown), which in turn is disposed over an upper material 17, such as satin. Below all these layers is an optional layer of outsole material 32, such as a flexible natural or synthetic layer of leather.

The pointe shoe 18 has an upper 17 for covering some desired portion of the dancer's foot beyond the toe box. The upper includes a vamp 20 which is generally that portion of the upper that is between the drawstring knot 22 and the top edge 24 of the toe box, though some European manufacturers define it as the distance between the drawstring knot and the edge of the pleats 26. The upper 17 includes a binding 28, which is the finished edge of the upper. A drawstring 30 may be encased in the binding, to further secure the shoe on the foot. Satin is often used as an upper material.

The shoe also includes a sole 32 that may connect directly or indirectly to the upper 17, shank 16, and/or toe box for contacting the floor or ground that generally is wear resistant and provides some desired degree of frictional engagement with the surface of contact. It may be made of natural leather, synthetic leather, other synthetic materials, natural rubbers, and other materials well known in the art. The sole may incorporate cushioning elements, such as molded polyurethane of ethyl vinyl acetate foams. It is contemplated that a stiff sole or variably stiff sole may be used as the support element to serve the function of a shank and that a separate shank is not required.

A lining or layer for comfort or cushioning, such as an in-sock 19 and/or insole 16, may be provided within the foot compartment of the shoe or toe padding 34.

Traditionally, toe boxes have been made of densely packed layers of fabric and paper, shaped and then dipped in glue. The hardened glue makes the toe box stiff. The inventive subject matter uses a thermosettable adhesive to provide a novel toe box assembly that keeps with the traditional form of manufacturing. Additionally or alternatively, the toe box and/or other region, such as midfoot region, may include a layer or a thermosettable plastic that may be molded into a stiff structure but adjusted upon application of heat.

In certain embodiments, the inventive subject matter is directed to a toe box that is relatively easily molded by a dancer for a custom fit. In certain embodiments, the present invention provides a toe box for a pointe or other dance shoe that is constructed from layers of toe box material that are treated with a thermoset adhesive such as water-based polyurethane, in place of the non-thermosetting adhesives that have previously been used in toe box constructions. The toe box may be heated by the dancer using, for example, a standard blow dryer or other heat source to make the toe box malleable. As indicated above, generally, heat application means a temperature above which the shoe is subjected to during its normal, intended use. For indoor dance performance, moldability occurs in a temperature range of from about 40 degrees C. to about 100 degrees C. While in the heated malleable condition, the dancer shapes the toe box into a desired configuration, and then allows the toe box to set into the configuration by cooling. The shoe may be placed in a reduced temperature environment, such as refrigerator, to facilitate cooling and setting. After each heavy session of dancing the shoe may become heated from use. This process may be repeated to make desired adjustments.

While the shoes remain heated, the dancer may reset the shoe, making further adjustments if necessary, by softening so the dancer is able to adjust, if necessary, and to cool the shoes again, in the refrigerator, for example, to maintain the fit and the stability and longevity of the shoes. The novel qualities of the inventive toe box allow the shoe to be broken-in much faster than a traditional pointe shoe constructed with regular paste and hessian, canvas and paper.

The dancer is able to work the shoe to her liking in a very short space of time compared against a hard, traditional pointe shoe that may take a dancer up to a week of hard wear and walking to reach the same level of comfort. Accordingly, with the inventive subject matter the dancer obtains a malleable shoe that they work to their liking, then place the shoes, for example, in a refrigerator or freezer overnight and the shoes will set hard in the desired form.

Thermoset adhesives suitable for use in the inventive subject matter are cross-linked polymeric resins that are cured using heat and/or heat and pressure. Cured thermoset resins may soften when heated, but generally do not melt or flow under the intended environmental conditions of use. Thermoset adhesives vary in terms of material compatibility and features. Some products adhere to ceramics or glass, concrete or masonry, metal, paper, plastic, rubber, or porous surfaces. Others are compatible with substrates made from composite materials, textiles, fabrics, wood, rubber, or elastomers. Thermoset adhesives that can bond dissimilar substrates such as metal to rubber are also available. Many thermoset adhesives have been found suitable for medical, pharmaceutical and food processing applications and meet requirements established by the Food and Drug Administration (FDA) and the U.S. Department of Agriculture (USDA). Accordingly, it is well expected that from the teachings herein, and using the well-established body of information on different types of thermoset adhesives, their properties, and intended uses, persons skilled in the art may select from any number of thermoset adhesives for use in constructing toe boxes, including those that are settable under the temperature or conditions of a standard blow dryer or other heat source. Thermoset resins suitable for use in constructing toe boxes generally also need to be workable in the process of shoe manufacturing. For example, they must not set too quickly or slowly that other shoe components cannot be easily integrated or attached to the materials being treated.

It is expected that suitable thermoset adhesives may be selected from the following group: phenolic, melamine, resorcinol formaldehyde, furan, polyester, polyimide and urea formaldehyde resins; acrylics, elastomers, epoxy resins, ceramic or inorganic cements, natural or synthetic rubbers, silicone compounds, fluoropolymers, phenolics, and formaldehyde resins; water-based and VOC-based polybutadiene, polyester, vinyl ester, polyvinyl acetate (PVA), polysulfide, polyurethane (PU) systems.

Water-based polyurethane adhesives are particularly suitable. For example, AQUACE W-01 is the trade name of one possible polyurethane based thermoset adhesive suitable for use in constructing the inventive toe boxes. The AQUACE W-01 adhesive is available from Dongsung NSC, www.dongsungnsc.com. It is a water-based polyurethane dispersion with a viscosity of 8,000-15,000 CPS/30+/−1 deg. C. It is miscible in water. It has a boiling point of about 100 deg. C. Other suitable adhesives are sold under the trade names Doorlock—3055—PVA, ETI-1586, PUR-BONDHB, 233 AGGRIP Acrylic, and PURWELD.

Traditional insoles, typically made of boards, leather fibers, textile or foamed materials are relatively weak and may break down quickly. This breakdown may facilitate greater load on and faster breakdown of the toe box, affecting dance performance and shoe life. To overcome this problem, the inventive subject matter disclosed herein contemplates plastic insoles that serve not only as an insole, but also as the underfoot structural element. The plastic or polymer suitable for such an insole/shank may be a material that is strong and resistant to breakage. Integrating such, insoles, into conventional or the inventive toe box supports the dancer in their shoes so that the insole takes more load and the box takes less. Therefore, the shoes should last longer than traditional pointe shoes that do not have the insole. In certain embodiments, the inventive toe box may be integrated with a plastic insole based on a polymer, such as polypropylene. As seen in the figures, the plastic insoles 16 may have a finish layer of a comfort or cushioning material. The plastic insole may be made selectively flexible by providing flexural lines directing the capability of the insole to flex. For example, a set of generally parallel spaced apart grooves, oriented transverse to the long axis of the shoe may be disposed on the bottom top and/or bottom side of insole, in the area of the arch to make it flex in a desired manner.

In summary, various constructions of a shank are contemplated under the inventive subject matter. In certain embodiments, the insole used in the shank may be formed of a strong and durable plastic and optimally is adapted for selective flexing. For example, the insole may include flexural lines to provide selective flexing, varying thickness, multi-density construction, and/or laminated materials. In some embodiments, the plastic insole may be made of a thermoset plastic and is moldable by a user's application of heat. In other embodiments, the plastic insole is assembled to other layers of material and the shank region is moldable by a user's application of heat. In other embodiments, the shank is formed from traditional materials. In other such embodiments, it is formed of traditional materials and treated with a thermoset adhesive so that it is moldable by a user's application of heat.

The insole 16 may come in ½, ¾ or full length and preferably are integrating into the toe box. As best seen in FIG. 1, the insole has a curved profile (raised arch) mimicking an en pointe position.

FIGS. 9A-F illustrate a set of possible steps for breaking-in or customizing a toe box of a ballet shoe made using thermoset materials, as described herein. The specific ballet shoe is based on a toe box that uses AQUACE W-01 thermosettable adhesive. This adhesive can be applied to a toebox otherwise composed of conventional layers of material to provide moldability at about 60 degrees C. It will set under about 40 degrees C. if left for an extended time. Refrigeration or other chilling will accelerate the process.

Figure 9A:
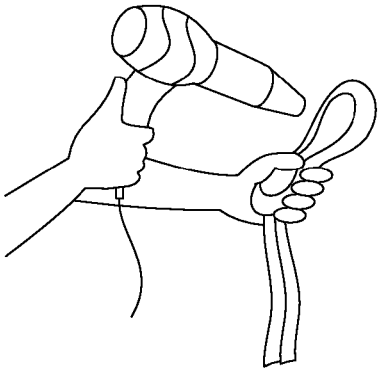
FIGS. 9A-J show a set of steps that may be used to customize a shoe's toe box or arch, according to the inventive subject matter.

FIG. 9A: Hold a standard blow dryer for hair about 4 inches from the demi-pointe area of the outsole. Apply heat for about 40 seconds.

Figure 9B:
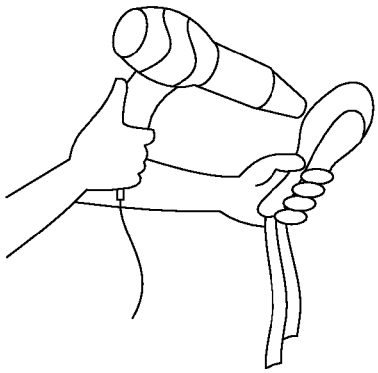

FIG. 9B: Heat each side for about 20 seconds. Heat the vamp (top of shoe, not platform) for 20 seconds. Heat the demi-pointe area of the outsole for about 20 seconds. Keep the blow dryer about 4 inches from the satin to avoid marks.

Figure 9C:
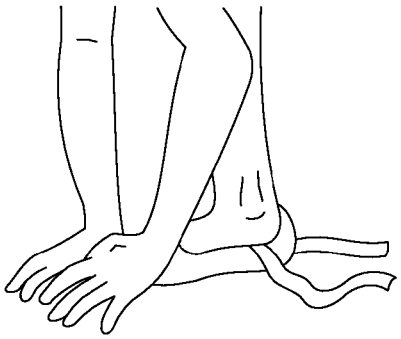

FIG. 9C: While the shoe is still warm but not too hot, put the shoe on. Massage the toe area, molding the shoe to the toe area, molding the shoe to the contours of the foot.

Figure 9D:
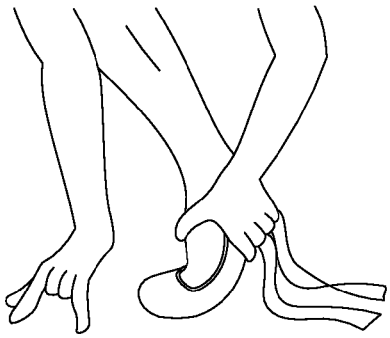

FIG. 9D: Gripping the heel of the shoe, work through demi-pointe 3 times.

Figure 9E:
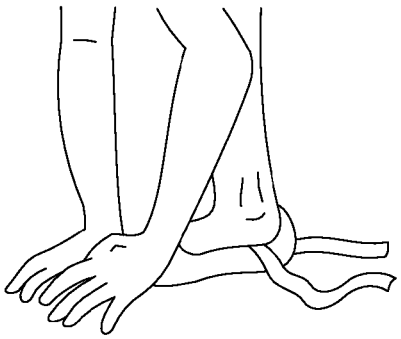

FIG. 9E: Stand flat in the shoe and massage the toe area again.

Figure 9F:
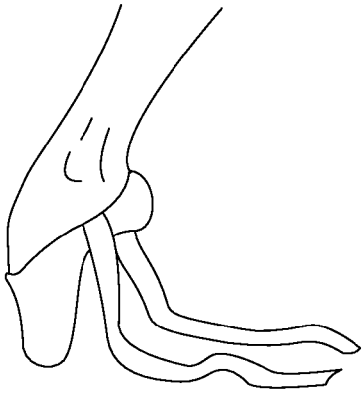

FIG. 9F: Do 3 tendues.

Figure 9G:
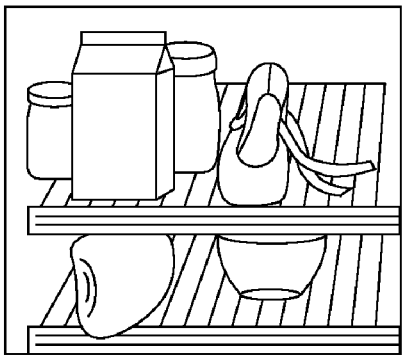

FIG. 9G: Leave shoe in the refrigerator for about 5 minutes to set.

Figure 9H:
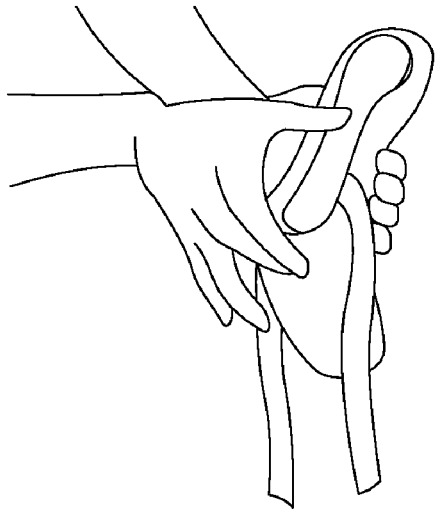

FIGS. 9H-G illustrate a set of steps for breaking-in or customizing the midfoot region of a ballet shoe optionally made using thermoset materials, as described herein. A specific ballet shoe may be based on a plastic or composite shank attaching to the toe box and spanning the midfoot. The shank material may be a non-thermosettable material or a thermosettable material, such as a thermosettable PVC. To achieve midfoot moldability, the shank may be incorporated into conventional midfoot materials using AQUACE W-01 adhesive or other thermoset adhesive on the shank and/or the associated layers. FIG. 8 generally represents a midfoot construction of a dance shoe that includes an insole 16 that serves as a shank and an optional outsole 32.

FIG. 9H: Fold back heel and put shoe on to identify the ¾ point of the arch area. Mark this point on the insole and then corresponding point on the outsole.

Figure 9I:
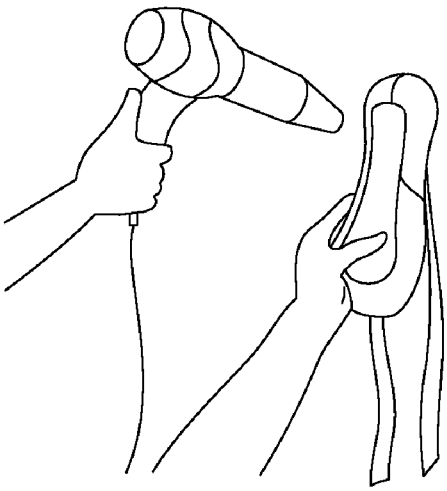

FIG. 9I: (i) Heat just above the mark on the outsole for about 20 seconds; (ii) heat just above the ¾ mark on the insole for 20 seconds. Repeat the step associated with FIG. 9A above.

Figure 9J:
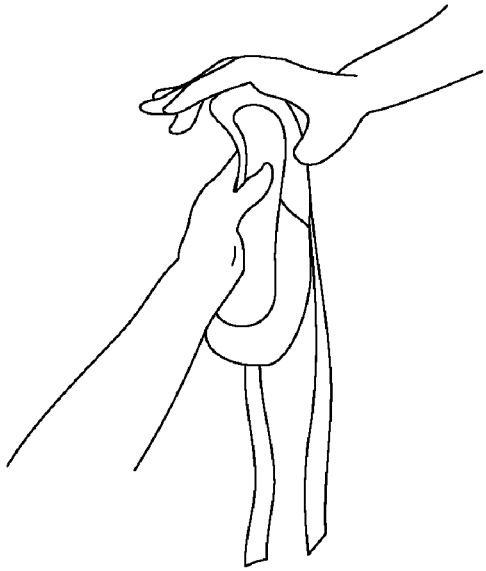

FIG. 9J: Firmly place a thumb on the ¾ mark on the outsole and bend the heel of the shoe down just above the ¾ mark. So not over-bend or bend below the ¾ mark.

FIG. 9G: Leave shoe in a refrigerator for about 5 minutes to set.

Persons skilled in the art will recognize that many modifications and variations are possible in the details, materials, and arrangements of the parts and actions which have been described and illustrated in order to explain the nature of the inventive subject matter and that such modifications and variations do not depart from the spirit and scope of the teachings and claims contained therein.

What is claimed:

1. A dance shoe comprising a compartment for surrounding a foot, at least a portion of the compartment comprising a plurality of layers of material at least one of which is treated with a thermoset adhesive so that the portion of the compartment is malleable under heat above an intended temperature of use and hand moldable by a wearer to a shape desired by the wearer; and wherein the portion of the compartment comprises a toe box assembly of layers of material comprising one or more layers of fabric, burlap, hessian cardboard, paper, plastic, and leather, so that at least one of the layers is treated with the thermoset adhesive to form a rigid toe box of the dance shoe.

2. The dance shoe of claim 1 wherein the portion of the compartment is substantially rigid over a temperature range of from about 35 degrees C. to about 38 degrees C. and is malleable at a temperature in between about 40 degrees C. and about 100 degrees C.

3. The dance shoe of claim 2 wherein the thermoset adhesive comprises polyurethane.

4. The dance shoe of claim 1 wherein the portion of the compartment further comprises a shank portion for a midfoot.

5. The dance shoe of claim 1 wherein the shoe comprises a material that is malleable upon application of heat from a blow dryer and is settable by placement in a refrigerator.

6. A dance shoe according to claim 1 further comprising an elongate plastic element for supporting at least the arch of a wearer standing on a front portion of the toe box.

7. A dance shoe comprising a toe box for dancing en pointe, and an insole structurally coupled to the toe box, the insole comprising an elongate plastic element for supporting at least the arch of a wearer standing on a front portion of the toe box; and wherein the insole is integrated into a toe box assembly of layers of material comprising one or more layers of fabric, burlap, hessian cardboard, paper, plastic, and leather, so that at least one of the layers is treated with the thermoset adhesive to form a rigid toe box of the dance shoe.

8. The dance shoe of claim 7 wherein the plastic element comprises a thermoset plastic that is malleable above an intended temperature of use heat and hand moldable by a wearer to a shape desired by a wearer.

9. The dance shoe of claim 7 wherein the insole comprises polyethylene.

10. The dance shoe of claim 7 wherein the insole is dimensioned to reside from a forefoot portion of the shoe to across at least the arch of the shoe.

11. The insole of claim 9 wherein the width of the insole approximately mirrors the shape and width of the overlying region of the wearer's foot.

12. A method of making a dance shoe comprising providing a compartment for surrounding a foot, at least a portion of the compartment comprising a plurality of layers of material;

treating at least one of the layers with a thermoset adhesive so that the portion of the compartment is malleable above an intended temperature of use and hand moldable by a wearer to a shape desired by the wearer; and wherein the portion of the compartment comprises a toe box assembly of layers of material comprising one or more layers of fabric, burlap, hessian cardboard, paper, plastic, and leather, so that at least one of the layers is treated with the thermoset adhesive to form a rigid toe box of the dance shoe.

13. The method of claim 12 wherein the portion of the compartment is substantially rigid over a temperature range of from about 35 degrees C. to about 38 degrees C. and is malleable at a temperature in between about 40 degrees C. and about 100 degrees C.

14. A dance shoe comprising a compartment for surrounding a foot, at least a portion of the compartment comprising a plurality of layers of material at least one of which is treated with a thermoset adhesive so that the portion of the compartment is substantially rigid over a temperature range of from about 35 degrees C. to about 38 degrees C. and is malleable at a temperature in between about 40 degrees C. and about 100 degrees C.;

wherein the portion of the compartment further comprises a midfoot portion for supporting at least the arch of a wearer standing on a front portion of a toe box; and wherein the portion of the compartment comprises a toe box assembly of layers of material comprising one or more layers of fabric, burlap, hessian cardboard, paper, plastic, and leather, so that at least one of the layers is treated with the thermoset adhesive to form a rigid toe box of the dance shoe.

15. The dance shoe of claim 14 wherein the shoe is en pointe shoe.

* * * * *